US011285738B2

(12) United States Patent
Mondloch

(10) Patent No.: US 11,285,738 B2
(45) Date of Patent: Mar. 29, 2022

(54) INK DRYER

(71) Applicant: Einstein Graphic Services, LLC, Freedom, WI (US)

(72) Inventor: Steve J. Mondloch, Freedom, WI (US)

(73) Assignee: Einstein Graphic Services, LLC, Freedom, WI (US)

( * ) Notice: Subject to any disclaimer, the term of this patent is extended or adjusted under 35 U.S.C. 154(b) by 36 days.

(21) Appl. No.: 16/887,136

(22) Filed: May 29, 2020

(65) Prior Publication Data

US 2020/0384779 A1 Dec. 10, 2020

Related U.S. Application Data

(60) Provisional application No. 62/857,100, filed on Jun. 4, 2019.

(51) Int. Cl.
*B41J 11/00* (2006.01)

(52) U.S. Cl.
CPC ..... *B41J 11/00218* (2021.01)

(58) Field of Classification Search
CPC ..... B41J 11/00218
See application file for complete search history.

(56) References Cited

U.S. PATENT DOCUMENTS

2012/0176439 A1 7/2012 Kanai et al.
2015/0022601 A1 1/2015 Ohnishi
2016/0332464 A1* 11/2016 Harayama ..... B41J 11/0022
2019/0344586 A1* 11/2019 Kawai ..... B41J 11/0024

OTHER PUBLICATIONS

PCT/US2020/035197 International Search Report and Written Opinion of the International Searching Authority dated Aug. 26, 2020 (11 pages).

* cited by examiner

*Primary Examiner* — Justin Seo
(74) *Attorney, Agent, or Firm* — SmithAmundsen LLC

(57) ABSTRACT

Ink dryers of the present technology include a heated platen configured to pivotally attach to a digital printer, and a controller that controls the temperature of the heated platen. The ink dryers may also include a current sensor that allows the controller to determine if whether the printer is active or asleep. The controller may turn on the heated platen when the printer is active, and turn off the heated platen when the printer is asleep.

19 Claims, 6 Drawing Sheets

INK DRYER

RELATED APPLICATIONS

This application claims priority to U.S. Provisional Application Ser. No. 62/857,100, filed on Jun. 4, 2019, the disclosure of which is hereby incorporated by reference in its entirety.

FIELD OF THE INVENTION

The present technology relates to ink dryers for high speed digital printers.

DESCRIPTION OF RELATED ART

High speed digital printers typically apply heat to the back of a substrate in order to cure ink printed onto the front thereof. However, such drying methods can be ineffective on materials with a thick backing paper or a thick media. Freestanding infrared heaters have been introduced that can be positioned to apply heat to the printed side of the substrate. However, such freestanding units generally have a narrow drying height and have little or no accurate control of the temperature the media achieves during the drying process. They are also prone to be too close or too far from the media, causing hot and cold areas across the width of the media. This typically yields either wet or heat damaged areas.

SUMMARY OF THE INVENTION

The present technology provides ink dryers that can be attached to and used with high speed digital printers.

In one aspect, an ink dryer for a digital printer is provided that comprises a heated platen that has an outer surface, and an inner surface configured to radiate heat. The ink dryer also comprises a controller operatively connected to the heated platen, and the controller includes a temperature controlling device that controls an amount of heat radiated by the heated platen. The heated platen is configured to pivotally attach to a digital printer.

In a second aspect, an ink dryer for a digital printer is provided that comprises a heated platen that has an outer surface, and an inner surface configured to radiate heat. The ink dryer also comprises a controller operatively connected to the heated platen, and the controller includes a temperature controlling device that controls an amount of heat radiated by the heated platen. The heated platen is configured to pivotally attach to a digital printer, and the heated platen is configured to pivot from an operation position to an open position.

In a third aspect, an ink dryer for a digital printer is provided that comprises a heated platen that has an outer surface, and an inner surface configured to radiate heat. The ink dryer also comprises a controller operatively connected to the heated platen, and the controller includes a temperature controlling device that controls an amount of heat radiated by the heated platen. The heated platen is configured to pivotally attach to a digital printer, and the heated platen is configured to pivot from an operation position to an open position. When in the operation position, the heated platen is offset and spaced apart from a post print platen of the digital printer, and a channel is be formed between the inner surface of the heated platen and an outer surface of the post print platen.

BRIEF DESCRIPTION OF THE DRAWINGS

Specific examples have been chosen for purposes of illustration and description, and are shown in the accompanying drawings, forming a part of the specification. Like numerals are used to designate like parts throughout the drawings. Various items of equipment, such as fittings, connectors, etc., may have been omitted from the drawings so as to simplify the description of the technology. However, those skilled in the art will realize that such conventional equipment may be employed and placed as desired.

DETAILED DESCRIPTION

Figure 1:
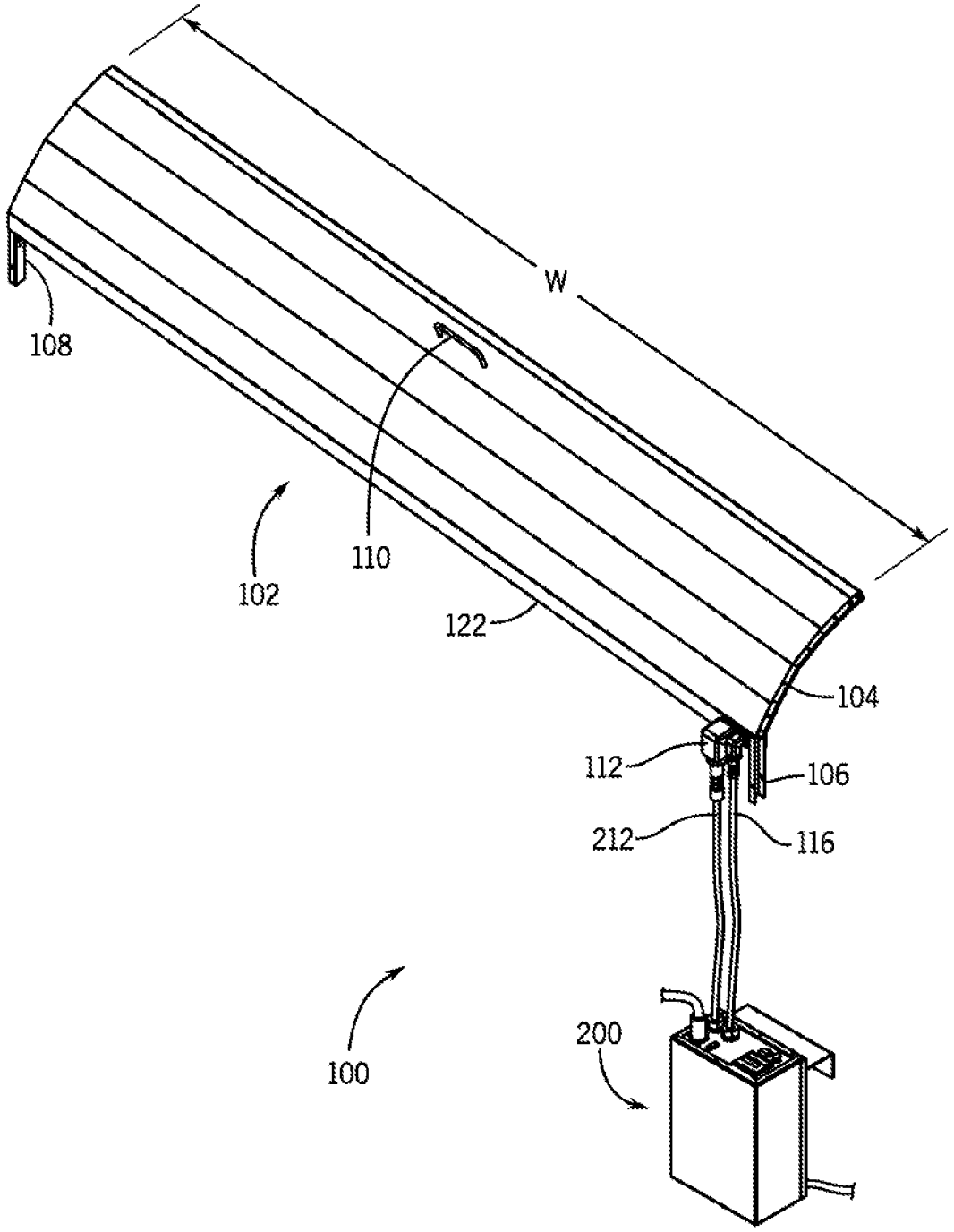
FIG. 1 shows one example of an ink dryer of the present technology.
Figure 2:
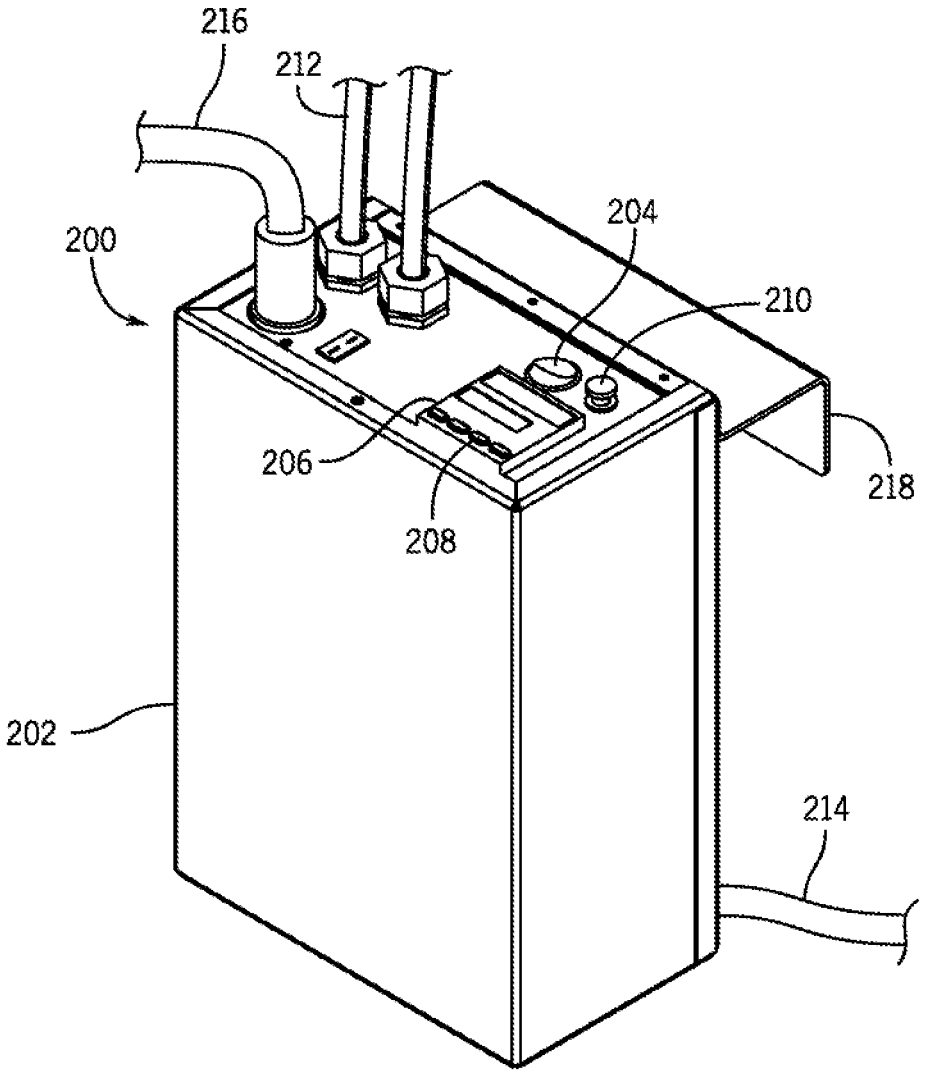
FIG. 2 shows perspective view of a controller of the present technology.
Figure 3:
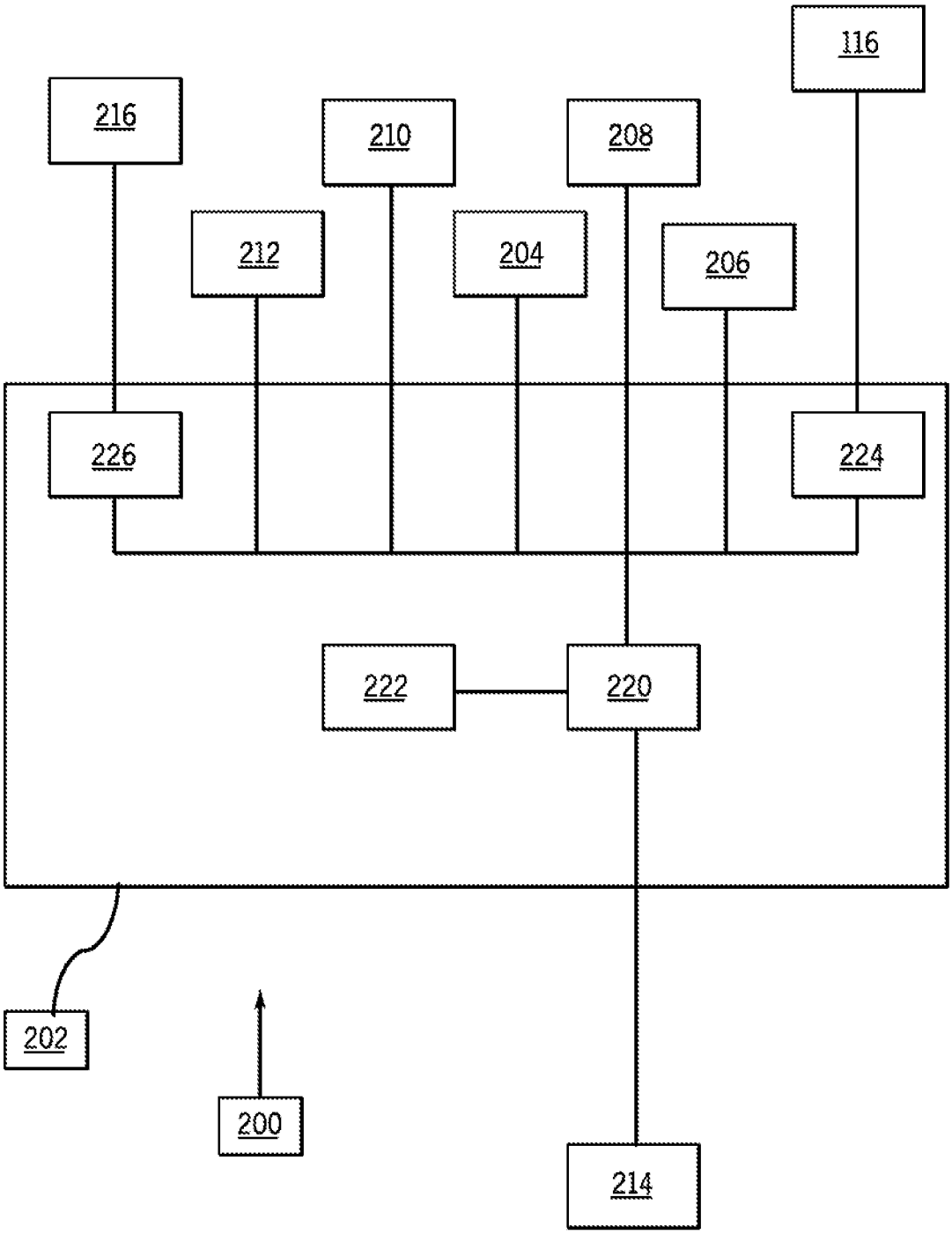
FIG. 3 shows a block diagram of the controller of FIG. 2.
Figure 4:
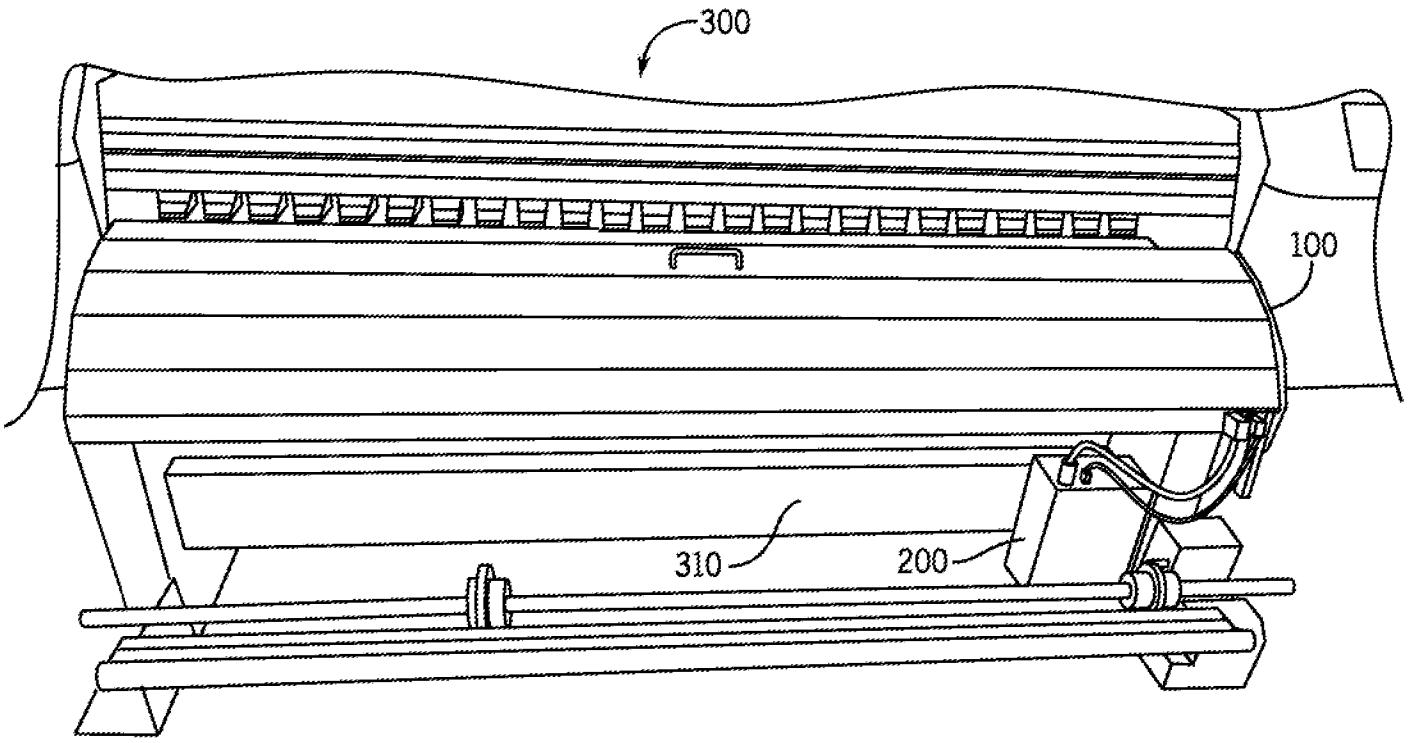
FIG. 4 shows a front view of a digital printer with an ink dryer of the present technology installed thereon.
Figure 5:
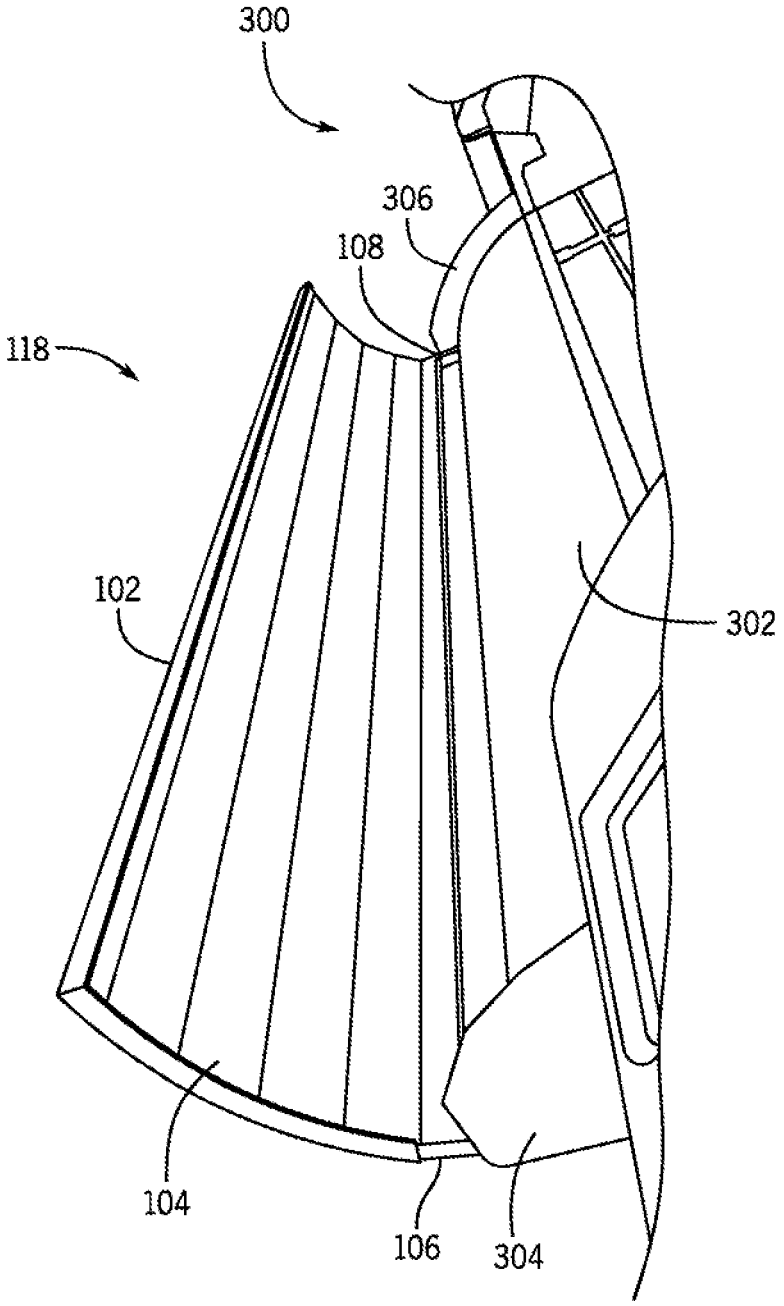
FIG. 5 shows a side view of a heated platen of the present technology installed on a digital printer, in an open position.
Figure 6:
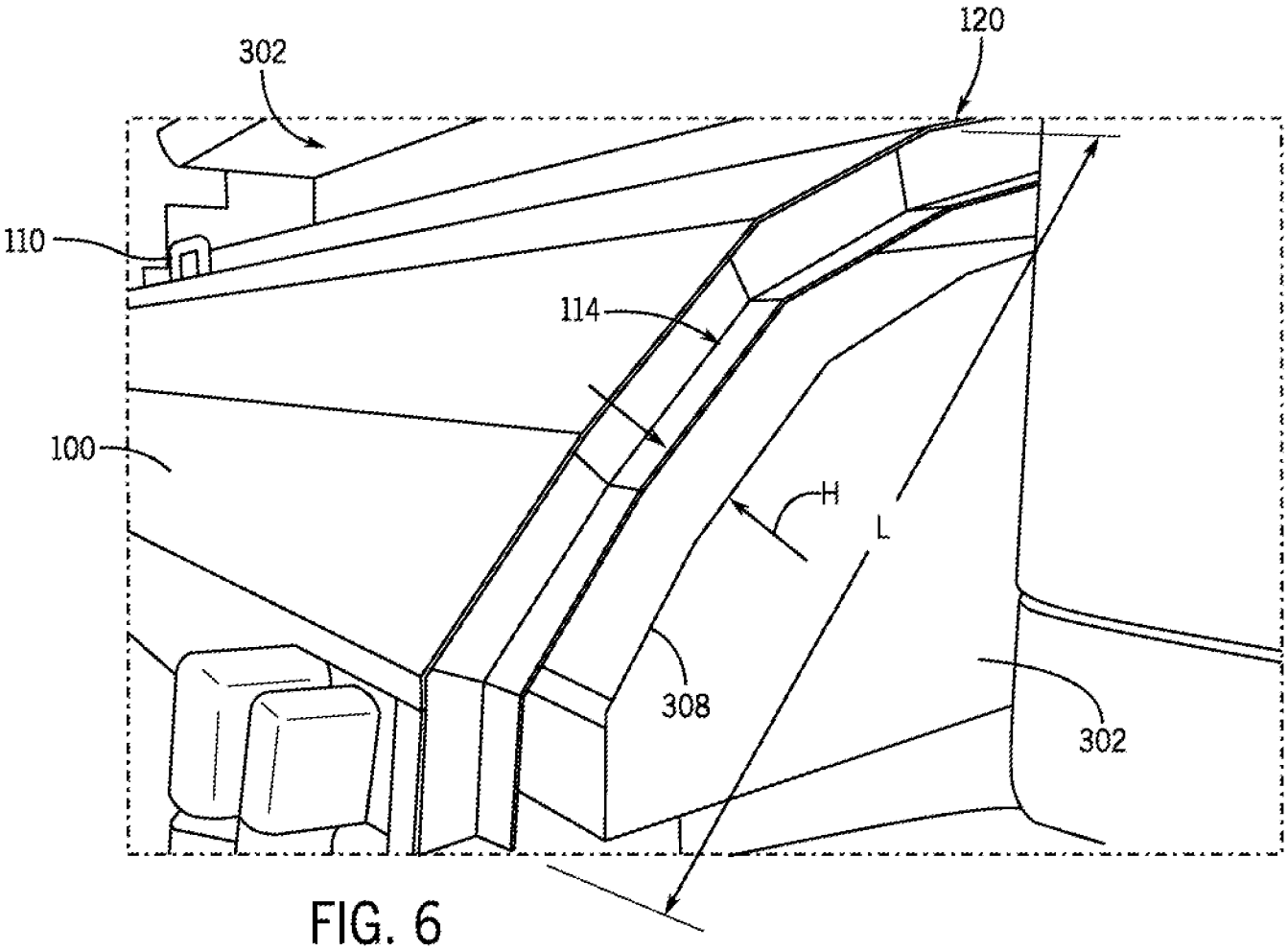
FIG. 6 shows a side view of a heated platen of the present technology installed on a digital printer, in an operation position.

As can be seen in FIGS. 1-6, ink dryers 100 of the present technology include a heated platen 102 configured to attach to a digital printer 300, and a controller 200 that operably attaches to the heated platen 102. FIG. 1 illustrates one example of an ink dryer 100 of the present technology. FIGS. 2 and 3 illustrate one example of a controller 200 of the present technology. FIGS. 4-6 show an example of a digital printer 300 having ink dryer 100 installed thereon.

As shown in FIGS. 4-6, the digital printer 300 can include a post print platen 302, onto which the substrate is fed once ink has been applied by the printer. The substrate is fed, ink side up, along the post print platen 302. In at least some digital printers, the post print platen 302 is heated, which provides heat to the bottom surface of the printed substrate.

As shown in FIGS. 1 and 4-6, the heated platen 102 may have a curved or segmented profile, with the curve or segmenting being configured to have the same profile as the printer's post print platen 302. The heated platen 102 may have an outer surface 122, an inner surface 104, and a width (W) that is substantially equal to the width of the printer's post print platen 302. The heated platen 102 has an inner surface 104, and is configured to radiate heat from the inner surface 104. The heated platen 102 may have a first mounting bracket 106 and a second mounting bracket 108, which can be used to attach the heated platen 102 to the digital printer 300. The heated platen 102 may have an open position 118, as shown in FIG. 5, and an operation position 120, as shown in FIG. 6. The heated platen 102 may also have a handle 110, which can be used to move the heated platen 102 between the open position 118, and the operation position 120. The heated platen 102 may also have at least one outlet 112, which may be configured to operably receive an electrical cord 212 that may provide power and/or send signals between the controller 200 and the heated platen 102.

The heated platen 102 may be installed on the digital printer 300 by pivotally attaching the first and second mounting brackets 106, 108 of heated platen 102 to the digital printer 300. As shown in FIG. 5, the digital printer 300 may have a first end plate 304 and a second end plate 306, to which the first mounting bracket 106 and a second mounting bracket 108, respectively, may be attached. The attachment may be accomplished in any suitable manner, including for example by using at least one fastener, such as pivot bolts.

When in it open position 118, as shown in FIG. 5, the heated platen 102 may be separated from the post print platen 302 sufficiently to allow a user to feed media onto the take up system or to examine the quality of the printed product.

When in its operation position 120, as shown in FIG. 6, a channel 114 may be formed between the inner surface 104 of the heated platen 102 and the outer surface 308 of the post print platen 302. The channel 114 has a height (H), and a length (L), and may be curved. The length of the channel 114 depends upon the length of the heated platen 102 and the post print platen 302, which may be the same, or substantially the same. In at least one example, the length of the channel 114 is at least about 12 inches. The height (H) of the channel may be measured from the outer surface 308 of the post print platen 302 to the inner surface 104 of the heated platen 102, and is preferably uniform across the length (L) of the channel 114, as well as across the width (W) of the heated platen 102. In at least one example, the height (H) of the channel 114 may be at least about ¾ of an inch.

During operation of ink dryers of the present technology, heat radiates from the inner surface 104 of the heated platen 102 onto the printed surface of a substrate, to facilitate drying or curing of the ink. The amount of heat applied to the printed substrate by the heated platen, either alone or in combination with a post print platen 302, may be substantially increased as compared to standard digital printers without ink dryers of the present technology. The increased heat may result in the ink on the substrate being dry enough upon exiting the channel 114 for it to be immediately wound on a take up roll without significant damage to the ink or substrate.

As shown in FIGS. 2 and 3, the controller 200 can include a housing 202. The controller may also include a mounting bracket 218, which may be configured to mount the controller 200 to a hang bar 310 of the digital printer.

The controller can include at least one processor 220, and at least one memory storage device 222. The at least one memory storage device 222 can be non-volatile and non-transient. The at least one memory storage device 222 can store any of a variety of types of information or data depending upon the embodiment or implementation. Among other things, the at least one memory storage device 222 can store software, applications, or computer instructions in accordance with which the at least one processor 220 operates. The at least one memory storage device 222 can store at least one controller algorithm that, when executed by the at least one processor 220, causes the controller 200 to control operation of the ink dryer 100, the heated platen 102, and/or the controller 200.

The at least one memory storage device 222 can take any of a variety of forms or encompass any of a variety of different types of memory storage devices depending upon the embodiment. For example, in some embodiments, at least one memory storage device 222 can employ any of magnetic disk storage, optical disk storage, random access memory (RAM) devices, read only memory (ROM) devices, compact disc read only memory (CD/ROM) devices, electrically erasable programmable read only memory (EEPROM) devices, or other forms of storage devices or computer-readable storage media. In some embodiments, the at least one memory storage device 222 and the at least one processor 220 may be incorporated into a single device that includes both processing and memory capabilities (e.g., a processor-in-memory or PIM) and, in such embodiments, such a device can be considered to be both at least one memory storage device 222 and at least one processor 220.

The controller 200 can include an electrical cord 212, which can be configured to be operably received by outlet 112 of heated platen 102, and may provide power and/or send signals between the controller 200 and the heated platen 102. The controller 200 may also include a power cord 214 that connects to a wall outlet or other power source at one end and is configured to provide power to at least one of the controller 200, the heated platen 102, and the digital printer 300. The ink dryer 100, and the associated heated platen 102 and controller 200 may be powered by any suitable power supply, and thus may also include at least one battery packs or ink dryer power cables. The controller 200 may also include at least one power relays and other components, as desired or necessary to allow for operation of the controller.

In examples where the controller 200 provides power to the digital printer 300, the controller 200 may include a printer power cord 216 that is configured to operatively connect to and provide power to the digital printer 300.

The controller 200 may include a heater on/off switch 204, which may allow a user to turn the heated platen on or off manually. However, while turning the heater on/off switch 204 to the off position may automatically turn the heated platen 102 off at any time, the controller may be configured to prevent the heated platen 102 from heating if the digital printer 300 is not active even if the heater on/off switch is in the on position.

The controller 200 may also include a display 206, and at least one programming buttons 208, which may allow a user to monitor the temperature in the channel 114 and set a specific operating temperature or temperature range for the controller to implement.

The controller 200 may also include a reset button 210, which allows a user to manually cause the controller 200 to restart in the event that it shuts down for any reason.

The controller 200 may also include a temperature controlling device 224. Referring to FIG. 1, ink dryers 100 of the present technology may also include a temperature sensor 116 that is operatively connected to the controller 200, and that monitors the temperature in the channel 114 when the heated platen 102 is on. The operative connections between the controller 200, the heated platen 102, and the temperature sensor 116 may be wired (as illustrated) or wireless. The temperature sensor 116 sends a temperature measurement signal to the temperature controlling device 224 of the controller 200, and the controller 200 may send a temperature control signal to the heated platen 102 to adjust the temperature or amount of heat being radiated from the inner surface 104 of the heated platen 102. In some examples, the controller may control the amount of heat being radiated from the inner surface 104 of the heated platen 102 to maintain the temperature within the channel within the range of from about 120° F. to about 190° F.

As shown in FIG. 3, a current sensing device 226 may be operatively connected to the printer power cord 216, either internally or externally to the controller housing 202. The current sensing device 226 senses the amount of power being drawn by the digital printer 300, and the controller 200 uses input from the current sensing device to determine whether the digital printer 300 is active or asleep. The controller 200 may send a first platen power signal to turn on the heated platen 102 when the digital printer is active, and a second platen power signal to turn off the heated platen 102 when the digital printer 300 is asleep. The controller 200 may be configured to only turn the heated platen 102 on when the digital printer 300 is active.

From the foregoing, it will be appreciated that although specific examples have been described herein for purposes of illustration, various modifications may be made without deviating from the spirit or scope of this disclosure. It is therefore intended that the foregoing detailed description be regarded as illustrative rather than limiting, and that it be understood that it is the following claims, including all equivalents, that are intended to particularly point out and distinctly claim the claimed subject matter.

What is claimed is:

1. An ink dryer for a digital printer, the ink dryer comprising:

a heated platen including an outer surface, and an inner surface configured to radiate heat;

a controller operatively connected to the heated platen, the controller including a temperature controlling device that controls an amount of heat radiated by the heated platen; and a printer power cable, and a current sensing device operatively connected to the controller that monitors the amount of current in the printer power cable;

wherein the controller uses input from the current sensing device to determine whether the digital printer is active or asleep; and wherein the heated platen pivotally attaches to a digital printer.

2. The ink dryer of claim 1, wherein the controller sends a first platen power signal to turn on the heated platen when the digital printer is active.

3. The ink dryer of claim 1, wherein the controller sends a second platen power signal to turn off the heated platen when the digital printer is asleep.

4. The ink dryer of claim 1, wherein the heated platen is configured to pivot from an operation position to an open position.

5. The ink dryer of claim 1, wherein the heated platen has an operation position in which the heated platen is offset and spaced apart from a post print platen of the digital printer, and a channel is be formed between the inner surface of the heated platen and an outer surface of the post print platen.

6. The ink dryer of claim 5, wherein the channel has a height and a length, the height of the channel being substantially uniform across the length of the channel.

7. The ink dryer of claim 5, wherein the height of the channel is about ¾ of an inch.

8. The ink dryer of claim 5, wherein the length of the channel is about 12 inches.

9. The ink dryer of claim 5, further comprising a temperature sensor operatively connected to the controller, wherein the temperature sensor monitors the temperature in the channel when the heated platen is on.

10. The ink dryer of claim 9, wherein the temperature sensor sends a temperature measurement signal to the temperature controlling device of the controller, and the controller sends a temperature control signal to the heated platen to adjust the temperature or amount of heat being radiated from the inner surface of the heated platen based on the temperature measurement signal.

11. The ink dryer of claim 10, wherein controller controls the amount of heat being radiated from the inner surface of the heated platen to maintain the temperature within the channel within the range of from about 120° F. to about 190° F.

12. The ink dryer of claim 10, wherein controller controls the amount of heat being radiated from the inner surface of the heated platen to maintain the temperature within the channel at an operation temperature set by a user.

13. An ink dryer fora digital printer, the ink dryer comprising:

a heated platen including an outer surface, and an inner surface configured to radiate heat;

a controller operatively connected to the heated platen, the controller including a temperature controlling device that controls an amount of heat radiated by the heated platen; and a printer power cable, and a current sensing device operatively connected to the controller that monitors the amount of current in the printer power cable;

wherein the controller uses input from the current sensing device to determine whether the digital printer is active or asleep; and wherein the heated platen pivotally attaches to a digital printer and the heated platen is configured to pivot from an operation position to an open position.

14. The ink dryer of claim 13, wherein, when in the operation position, the heated platen is offset and spaced apart from a post print platen of the digital printer, and a channel is formed between the inner surface of the heated platen and an outer surface of the post print platen.

15. The ink dryer of claim 13, further comprising a temperature sensor operatively connected to the controller, wherein the temperature sensor monitors the temperature in the channel when the heated platen is on.

16. The ink dryer of claim 15, wherein the temperature sensor sends a temperature measurement signal to the temperature controlling device of the controller, and the controller sends a temperature control signal to the heated platen to adjust the temperature or amount of heat being radiated from the inner surface of the heated platen based on the temperature measurement signal.

17. An ink dryer for a digital printer, the ink dryer comprising:

a heated platen including an outer surface, and an inner surface configured to radiate heat;

a controller operatively connected to the heated platen, the controller including a temperature controlling device that controls an amount of heat radiated by the heated platen; and a printer power cable, and a current sensing device operatively connected to the controller that monitors the amount of current in the printer power cable;

wherein the controller uses input from the current sensing device to determine whether the digital printer is active or asleep; and wherein the heated platen pivotally attaches to a digital printer and the heated platen is configured to pivot from an operation position to an open position, and when in the operation position, the heated platen is offset and spaced apart from a post print platen of the digital printer, and a channel is formed between the inner surface of the heated platen and an outer surface of the post print platen.

18. The ink dryer of claim 17, further comprising a temperature sensor operatively connected to the controller, wherein the temperature sensor monitors the temperature in the channel when the heated platen is on.

19. The ink dryer of claim 18, wherein the temperature sensor sends a temperature measurement signal to the temperature controlling device of the controller, and the controller sends a temperature control signal to the heated platen to adjust the temperature or amount of heat being radiated from the inner surface of the heated platen based on the temperature measurement signal.

* * * * *